US007316517B2

(12) United States Patent
Russo

(10) Patent No.: US 7,316,517 B2
(45) Date of Patent: Jan. 8, 2008

(54) BINDER WITH PULL-OUT INTERNAL POSTER

(75) Inventor: Steve Russo, Brooklyn, NY (US)

(73) Assignee: Fashion Accessory Bazaar LLC, New York, NY (US)

( * ) Notice: Subject to any disclaimer, the term of this patent is extended or adjusted under 35 U.S.C. 154(b) by 0 days.

(21) Appl. No.: 11/378,969

(22) Filed: Mar. 17, 2006

(65) Prior Publication Data

US 2007/0086847 A1 Apr. 19, 2007

Related U.S. Application Data

(60) Provisional application No. 60/718,010, filed on Sep. 16, 2005.

(51) Int. Cl.
*B42F 13/00* (2006.01)

(52) U.S. Cl. ..... 402/79; 281/29; 283/34

(58) Field of Classification Search ..... 281/29, 281/36–38; 283/34; 402/57, 73, 79
See application file for complete search history.

(56) References Cited

U.S. PATENT DOCUMENTS 4,487,431 A * 12/1984 Kelly ..... 283/117
5,419,586 A * 5/1995 Golson ..... 283/34
5,712,606 A * 1/1998 Sarkka ..... 333/219.1
2005/0095057 A1 * 5/2005 O'Hara ..... 402/57

* cited by examiner

*Primary Examiner*—Dana Ross
(74) *Attorney, Agent, or Firm*—Sperry, Zoda & Kane

(57) ABSTRACT

The present invention provides an incentive for buying a ring binder or a spiral notebook. The incentive is provided by having the binder or notebook include one or more internal folded sheets, preferably in the form of poster panels, which may be disposed within the binder or notebook and thereafter removed and, in the case of multiple sheets, unfolded for display separate from the binder or notebook. The poster panel or panels may coordinate with artwork on the cover of the binder or notebook.

19 Claims, 5 Drawing Sheets

FIG. 3
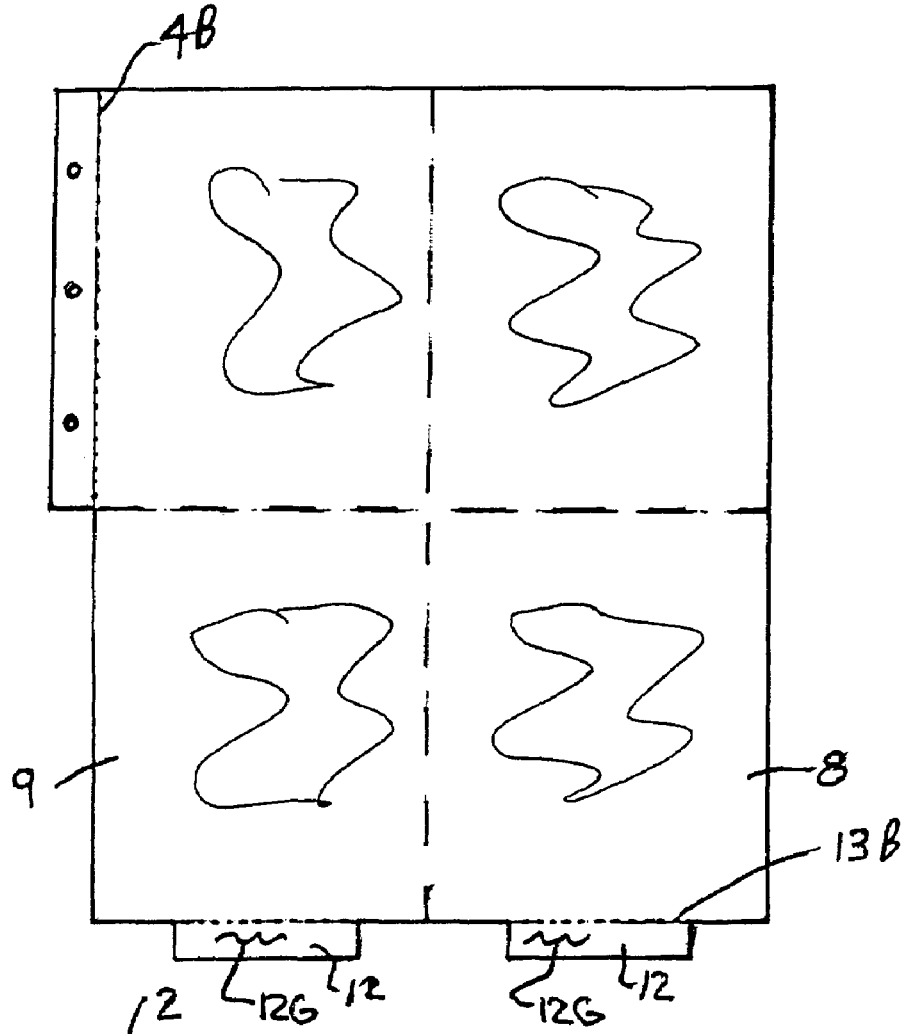
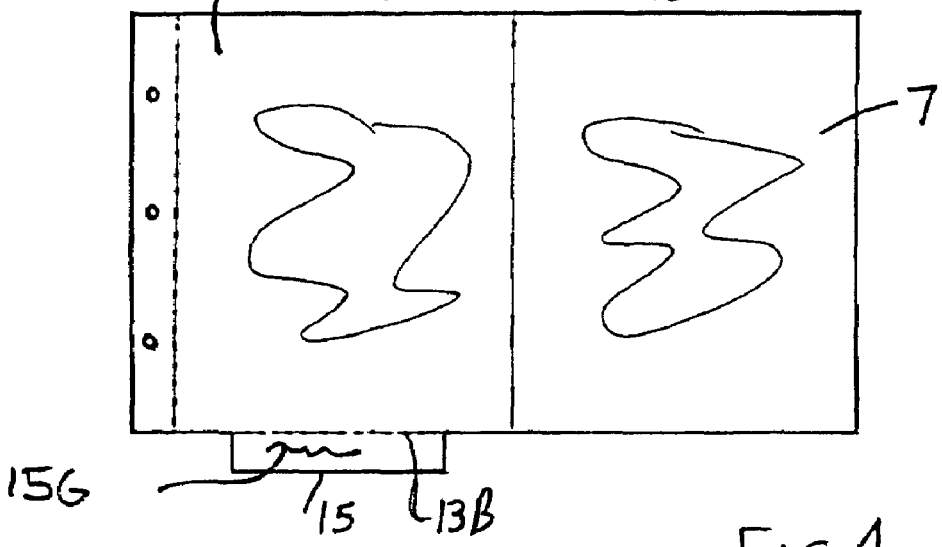
FIG. 4

BINDER WITH PULL-OUT INTERNAL POSTER

This application claims priority of Provisional Application Ser. No. 60/718,010 filed Sep. 16, 2005.

BACKGROUND OF THE INVENTION

Ring binders are traditionally constructed to accept precut sheets of paper with perforated holes in symmetry with the rings of the binder. In the case of a ring binder, additional individual sheets of paper can be purchased with precut holes, or additional sheets of paper can be perforated with a punch, typically a 2-hole or 3-hole punch, to be added to the binder.

There are a multitude of such ring binders on the market. Most typically, the front covers of these items are of a solid color (e.g., black or green). More importantly, there is nothing to differentiate one ring binder from another (other than size and amount of paper). As such, these items are mere "commodities" and a user is not inclined to buy one ring binder from others of the same size and comparable number of sheets of paper.

The same is true of spiral notebooks in which the paper is "bound" into the notebook via a spiral spring. That is, there are a multitude of such spiral notebooks available, but little has been done to differentiate one from the other (other than by size and number of sheets of paper) in terms of having a purchaser choose one over the other.

SUMMARY OF THE INVENTION

The present invention provides an incentive for buying a ring binder or a spiral notebook. According to one embodiment of the present invention, the incentive is provided by having the binder or notebook include one or more internal folded sheets, preferably in the form of poster panels, which may be disposed within the binder or notebook and thereafter removed and, in the case of multiple sheets, unfolded for display separate from the binder or notebook. The poster panel or panels may coordinate with artwork on the cover of the binder or notebook. In another embodiment of the invention, the sheet or sheets include one or more appendages, such as bookmarks, pictures or note writing sheets, which are detachable from the sheet or sheets. These appendages may coordinate with artwork on the sheets and/or with the artwork on the cover of the binder or notebook.

Accordingly, it is an object of the invention to provide an improved ring binder or spiral notebook.

BRIEF DESCRIPTION OF THE DRAWINGS

For a fuller understanding of the invention, reference is made to the following drawings in which:

FIG. 3 is a front elevational view, similar to that of FIG. 2, showing an embodiment of the invention, in which the sheet or poster panels include two appendages extending respectively from two of the four sheets;

FIG. 4 is a front elevational view showing two multiple sheets or poster panels, with the sheets unfolded, and showing a single appendage extending from one of the sheets;

DETAILED DESCRIPTION OF THE INVENTION

Figure 1:
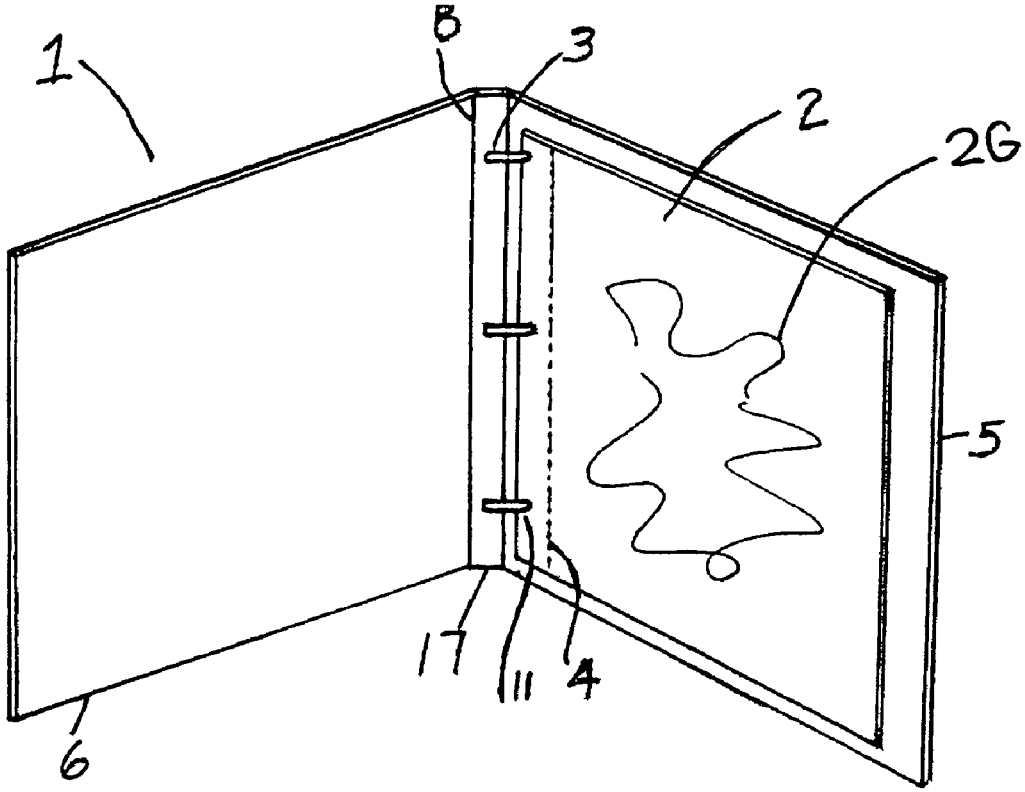
FIG. 1 is a front perspective view of a ring binder according the present invention, with the ring binder open to show a folded sheet or poster panel disposed therein.

FIG. 1 illustrates the invention in the form of a ring binder 1. Ring binder 1 includes a rear jacket or rear cover 5 and a front jacket or front cover 6. A spine 17 joins jackets 5 and 6. Spine 17 also provides a mounting for rings 3 that open and close to hold paper within the ring binder. In accordance with one aspect of the invention, ring binder 1 also includes sheet or poster panel 2 which is retained within the binder by rings 3. Poster panel 2 preferably includes graphics 2G printed or otherwise disposed thereon.

Figure 2:
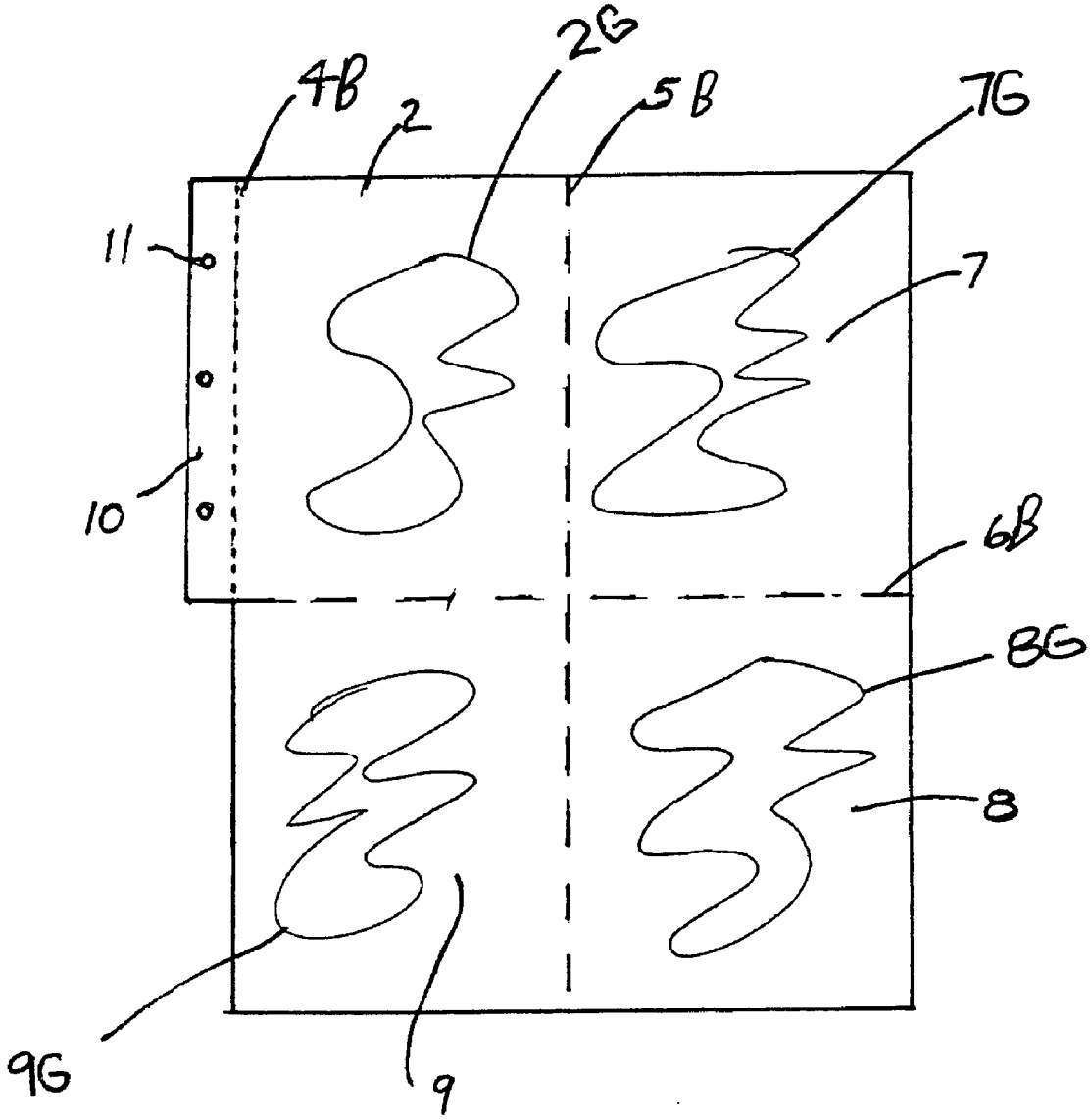
FIG. 2 is a front elevational view showing four multiple sheets or poster panels, with the sheets unfolded and with the ring binder eliminated for clarity.

As shown in FIG. 2, sheet 2 is provided with holes 11. Each hole is situated to cooperate and be received by one of the binder rings 3. Unfolding sheet 2, as shown in FIG. 2, reveals three secondary sheets or poster panels 7, 8 and 9. In order to fold panels 7, 8 and 9, such that the poster may be folded within ring binder 1, the scoring of the sheets is made at 5B and 6B.

Preferably, the secondary sheets or poster panels include graphics 7G, 8G and 9G, respectively. Graphics 2G, 7G, 8G and 9G may, for example, provide images that form a single poster image. For example, a rock and roll star or band, or a scene from a movie. To further provide a sales incentive, the graphics may coordinate with, or be complementary to, artwork on the front of front jacket 6. For example, the front of front jacket 6 may show a different scene from the movie depicted on the inside poster.

In order to remove sheet or poster panel 2, a tab 10 is located at the side of the sheet or poster panel. In addition to containing perforated holes 11, the tab is provided with a perforated tear line 4B. This tear line allows the user to detach the entire sheet or poster, leaving only tab 10 held by rings 3 of the ring binder. Once detached and unfolded, the entire poster may be displayed separately from the ring binder.

In FIG. 3 a similar construction as in FIG. 2 is shown. FIG. 3 includes, however, appendages 12 which extend, respectively, from secondary sheets or poster panels 8 and 9. These tab-like appendages may take the form of bookmarks, pictures or writing paper. Again, it is preferable that the appendages include graphics 12G which may coordinate with, or be complementary to, the graphics on the poster panels and/or on the front of front cover 6. The appendages are foldable and detachable from panels 8 or 9 along tear line 13B.

FIG. 4 shows a two sheet or poster panel embodiment having a main sheet or poster panel 2 and a single secondary sheet or poster panel 7. Detachable tab-like appendage 15 extends from sheet 2. Appendage 15, which includes graphics 15G, is foldable and is detachable from sheet 2 at tear line 13B.

Figure 5:
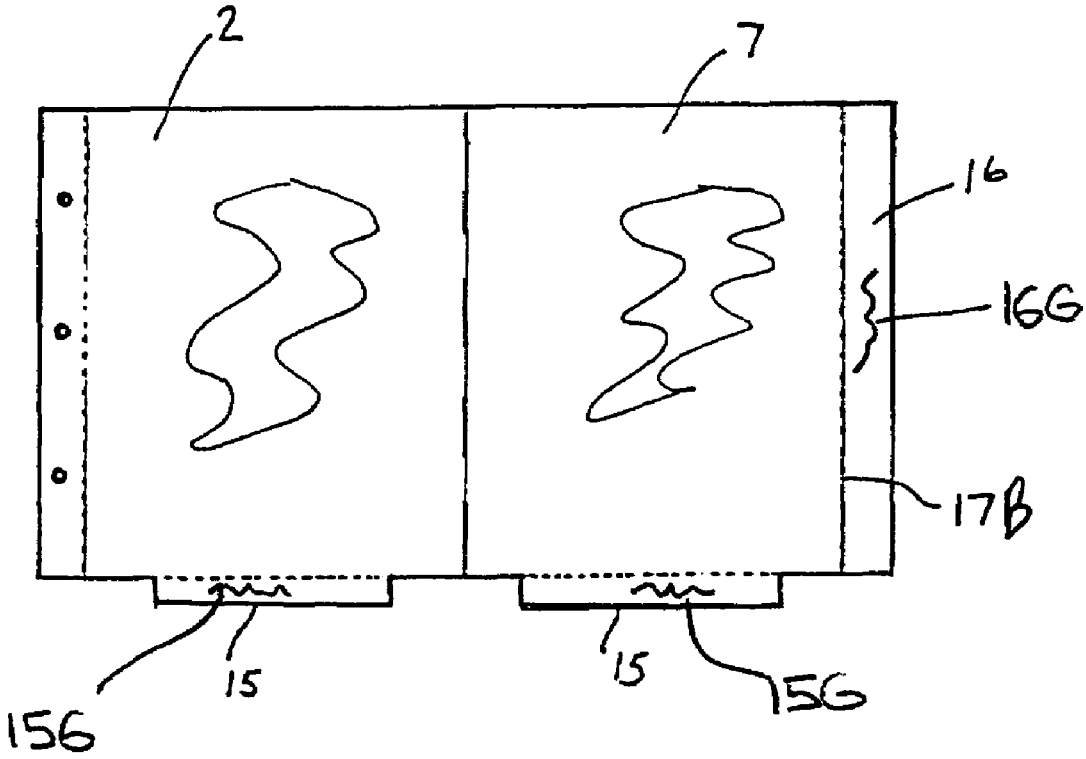
FIG. 5 is a front elevational view, similar to that of FIG. 4, showing two appendages, each extending from respective ones of the sheets.

In FIG. 5, two additional tab-like appendages are provided. Appendage 15 extends from secondary sheet or poster panel 7 and is substantially the same as appendage 15 that extends from primary sheet or poster panel 2. Another appendage 16 extends from poster panel 7 and is foldable and removable along perforated tear line 17B. The appendages may carry coordinating or complementary graphics 15G and 16G.

Figure 6:
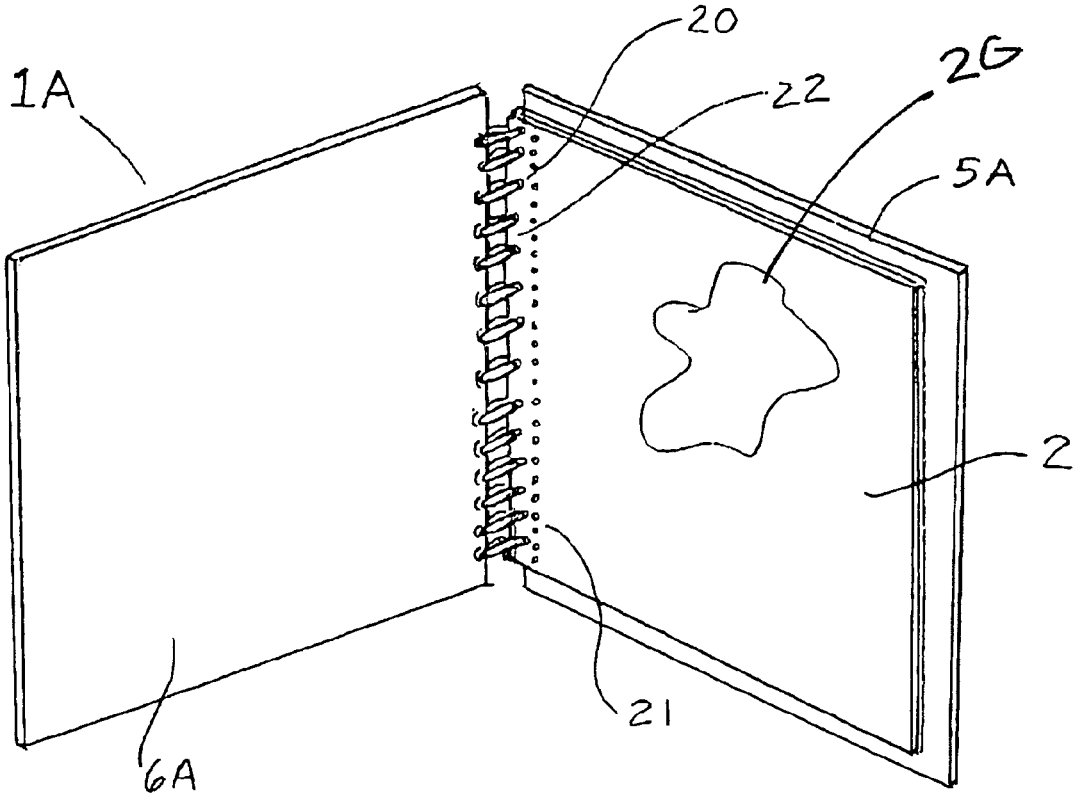
FIG. 6 is a front perspective view, similar to that of FIG. 1, but showing a spiral notebook according to the present invention.

FIG. 6 shows an embodiment of the invention in the form of a spiral notebook in which spiral 20 retains sheet or poster panel 2 in place. Spiral 20, made of plastic or steel, is contained between front cover or front jacket 5A and 6A and sheet or poster panel 2 is contained therein. Sheet or poster panel 2 is of the same construction as those constructions previously described, except the holes 11 for the ring binder are not used. Sheet or poster panel 2 is removed from spiral 20 by applying a tear force on perforations 21 to separate the sheet, leaving a portion 22 still attached to spiral 20.

The scope of the invention will now be indicated in the claims.

The invention claimed is:

1. A stationary binder apparatus comprising:

A. a front jacket member defining a front inner edge, a front outer edge, a front upper edge and a front lower edge thereon;

B. a rear jacket member defining a rear inner edge, a rear outer edge, a rear upper edge and a rear lower edge thereon;

C. a joining means attached along said front inner edge of said front jacket member and along said rear inner edge of said rear jacket member for movably joining said front jacket member and said rear jacket member together;

D. a panel means attached to said joining means at a position between said front jacket member and said rear jacket member to be retained therebetween, said panel means including:

(1) an tab portion being detachably securable with respect to said joining means for facilitating retaining of said panel means between said front jacket member and said rear jacket member;

(2) a graphics panel portion detachably attached to said tab portion, said graphics panel portion including panel graphics displayed thereupon, said graphics panel portion comprising:

a. a first sheet member including a first inner edge and a first outer edge and first horizontal edges extending therebetween;

b. a second sheet member including a second inner edge and a second outer edge and second horizontal edges extending therebetween, said second inner edge of said second sheet member being secured to said first outer edge of said first sheet member;

c. a first scoring line extending along the intersection between said second inner edge and said first outer edge to facilitate folding therealong to allow folding of said second sheet member with respect to said first sheet member; and (3) a tear line extending between said graphics panel portion and said tab portion to facilitate detachment of said graphic panel portion therefrom for facilitating display of said graphic panel portion and said panel graphics depicted thereon separately, said first inner edge extending along said tear line to facilitate selective detachment of said first sheet member of said graphics panel portion from said tab portion.

2. A stationary binding apparatus as defined in claim 1 wherein said tear line comprises a perforated line to facilitate detaching of said graphics panel portion from said tab portion.

3. A stationary binding apparatus as defined in claim 1 wherein front panel means includes front jacket graphics displayed thereon which is in complementing coordination with respect to said panel graphics displayed on said graphics panel portion.

4. A stationary binding apparatus as defined in claim 3 wherein said panel graphics on said graphics panel portion and said front jacket graphics on said front jacket member are the same.

5. A stationary binding apparatus as defined in claim 1 wherein said first sheet member and said second sheet member are of approximately the same size to facilitate said second sheet member extending over and across said first sheet member responsive to folding thereof along said first scoring line.

6. A stationary binding apparatus as defined in claim 5 wherein said first sheet member and said second sheet member are each smaller than said front jacket member and said rear jacket member to facilitating retaining of said first sheet member and said second sheet member positioned contained therebetween.

7. A stationary binding apparatus as defined in claim 1 wherein said first sheet member includes first sheet graphics displayed thereon and wherein said second sheet member includes second sheet graphics displayed thereon and wherein said first sheet graphics and said second sheet graphics are in complementary coordination with respect to one another.

8. A stationary binding apparatus as defined in claim 7 wherein said first sheet graphics and said second sheet graphics comprises selective portions of a single overall graphics depiction when viewed together unfolded.

9. A stationary binding apparatus as defined in claim 7 wherein said first sheet graphics and said second sheet graphics are the same.

10. A stationary binding apparatus as defined in claim 7 wherein said first sheet graphics, said second sheet graphics, said third sheet graphics and said fourth sheet graphics are the same.

11. A stationary binding apparatus as defined in claim 1 wherein said graphics panel portion further comprises:

A. a third sheet member including a third inner edge and a third outer edge and third horizontal edges extending therebetween, one of said third horizontal edges of said third sheet member being secured to one of said first horizontal edges of said first sheet member;

B. a second scoring line extending along the intersection between said first sheet member and said third sheet member to facilitate folding therealong to allow folding of said third sheet member with respect to said first sheet member for facilitating selective positioning thereof folded between said front jacket member and said rear jacket member;

C. a fourth sheet member including a fourth inner edge and a fourth outer edge and fourth horizontal edges extending therebetween, one of said fourth horizontal edges of said fourth sheet member being secured to one of said second horizontal edges of said second sheet member, said fourth inner edge of said fourth sheet member being secured to said third outer edge of said third sheet member;

D. a third scoring line extending along the intersection between said fourth sheet member and said second sheet member to facilitate folding therealong to allow selective folding of said fourth sheet member with respect to said second sheet member; and E. a fourth scoring line extending along the intersection between said fourth sheet member and said third sheet member to facilitate folding therealong to allow selective folding of said fourth sheet member with respect to said third sheet member.

12. A stationary binding apparatus as defined in claim 11 wherein said first sheet member, said second sheet member, said third sheet member and said fourth sheet member are approximately equal in size to facilitate folding thereof along said first scoring line, said second scoring line, said third scoring line and said fourth scoring line.

13. A stationary binding apparatus as defined in claim 12 wherein said first sheet member, said second sheet member, said third sheet member and said fourth sheet member are each smaller than said front jacket member and said rear jacket member to facilitating retaining thereof therebetween.

14. A stationary binding apparatus as defined in claim 11 wherein said first sheet member includes first sheet graphics displayed thereon and wherein said second sheet member includes second sheet graphics displayed thereon and wherein said third sheet member includes third sheet graphics displayed thereon and wherein said fourth sheet member includes fourth sheet graphics displayed thereon and wherein said first sheet graphics, said second sheet graphics, said third sheet graphics and said fourth sheet graphics are in complementary coordination with respect to one another.

15. A stationary binding apparatus as defined in claim 14 wherein said first sheet graphics, said second sheet graphics, said third sheet graphics and said fourth sheet graphics comprise selective portions of a single overall graphics depiction when viewed together unfolded.

16. A stationary binding apparatus as defined in claim 1 wherein said panel means includes an appendage secured along an edge thereof wherein said appendage is selected from a group consisting of a bookmark, picture or writing paper.

17. A stationary binding apparatus as defined in claim 1 wherein said joining means comprising a spiral binding means extending through said front jacket member, said rear jacket member and said tab portion of said panel means to facilitate binding thereof together.

18. A stationary binding apparatus as defined in claim 1 wherein said joining means comprises a binding member with a plurality of ring members secured thereto, said binding member movably secured to said front jacket member and said rear jacket member, said ring members extending through said panel means to facilitate movable attachment thereof with respect to one another and with respect to said front jacket member and said rear jacket member.

19. A stationary binding apparatus as defined in claim 1 wherein said panel means comprises a plurality of individual panel members.

* * * * *